US005964637A

United States Patent [19]

Hardaway

[11] Patent Number: 5,964,637

[45] Date of Patent: Oct. 12, 1999

[54] CRANK SPINNING HOOP

[76] Inventor: Mitchell Hardaway, 26215 Meadowbrook Way, Lathrup Village, Mich. 48076

[21] Appl. No.: 09/121,563

[22] Filed: Jul. 23, 1998

[51] Int. Cl.[6] ..... A63H 33/02

[52] U.S. Cl. ..... 446/246; 446/236

[58] Field of Search ..... 434/225, 247; 446/236, 246, 266, 450

[56] References Cited

U.S. PATENT DOCUMENTS

| | | | |
|---|---|---|---|
| 3,528,194 | 9/1970 | Motluk | 446/247 |
| 3,935,668 | 2/1976 | Phillips | 446/450 |
| 4,037,356 | 7/1977 | Chantland | 446/247 |
| 4,100,697 | 7/1978 | Ward | 446/236 X |
| 4,117,625 | 10/1978 | O'Neil | 446/266 |
| 4,148,153 | 4/1979 | Phillips | 446/450 |

FOREIGN PATENT DOCUMENTS

| | | | |
|---|---|---|---|
| 1326281 | 3/1963 | France | 446/266 |
| 2640143 | 3/1978 | Germany | 446/266 |

*Primary Examiner*—John A. Ricci

[57] ABSTRACT

A crank is tangentially placed on a hoop by incorporating a tee member. The crank is rotatable 36° degrees within the tee member. A handle extends from the crank arm and pivots to a position 90° degrees of the crank arm to gain mechanical advantage to rotate and manipulate the hoop. A hand grip fits over the crank handle. As the crank is manipulated to impart revolutions to the hoop, the entire mechanism rotates within the axis of the handle and the hand grip.

3 Claims, 4 Drawing Sheets

CRANK SPINNING HOOP

BACKGROUND OF THE INVENTION

1. Field of the Invention

The field of invention relates to the field of lariats and trick ropes. More specifically, the present invention relates to an amusement device that can be used in the same manner as a lariat or a trick rope.

2. Prior Art

Duplicating feats performed by professional lariat users, is very difficult for the unskilled, or untrained person. Prior art disclosed several hoop, and cord devices, that are intended to be used in the same manner that lariats are used. These devices have managed to solve one problem encountered by lariat users—the problem of keeping a large noose formed. Prior art solves this problem by using a substantially rigid hoop as part of the device. Unfortunately, these devices are difficult to control, using a cord. Examples of such devices are, Chantland U.S. Pat. No. 4,037,356 and Motluk U.S. Pat. No. 3,528,194.

A Large substantially rigid hoop, requires a more substantial means to control the hoop and perform the kind of maneuvers possible with a lariat or trick rope. The present invention provides a lightweight device that can be used in the same manner as a lariat. It is a high performance device, that provides a degree of control unattainable with prior art hoop and cord devices. Further drawings and descriptive matter will show these and other objects are apparent to one skilled in the art.

SUMMARY OF THE INVENTION

The principal object of the present invention, is to provide an amusement device, that can be used in much the same manner as a lariat is used.

It is also an object of the present invention to provide a device that is of simple, inexpensive construction.

Another object of the present invention is to provide a lightweight device that can safely be used by children and others.

A further object is to provide a high-tech device, which in use, will enable an unskilled person, in a short amount of time, to duplicate many of the maneuvers performed by professional lariat and trick rope users.

The foregoing objects can be accomplished by providing an amusement device composed of a rigid hoop, and a crank tangentially placed on a hoop. The hoop and crank are connected by way of a tee member, with the crank arm placed perpendicular to a tangent point on the hoop. The crank arm is rotatable 360° degrees, on an axis that is perpendicular to an attachment point on the hoop. The crank handle extends from the crank arm, and swivels to a position 90° degrees of the crank arm to gain mechanical advantage to impart revolutions to the device. A hand grip fits over the handle, enabling the handle to rotate freely within the device. The revolutions imparted to the device causes it to rotate within the axis of the crank handle and hand grip, not the attachment point of the hoop and crank. This device allows a degree of control not possible with prior art hoop devices.

DETAILED DESCRIPTION

Figure 1:
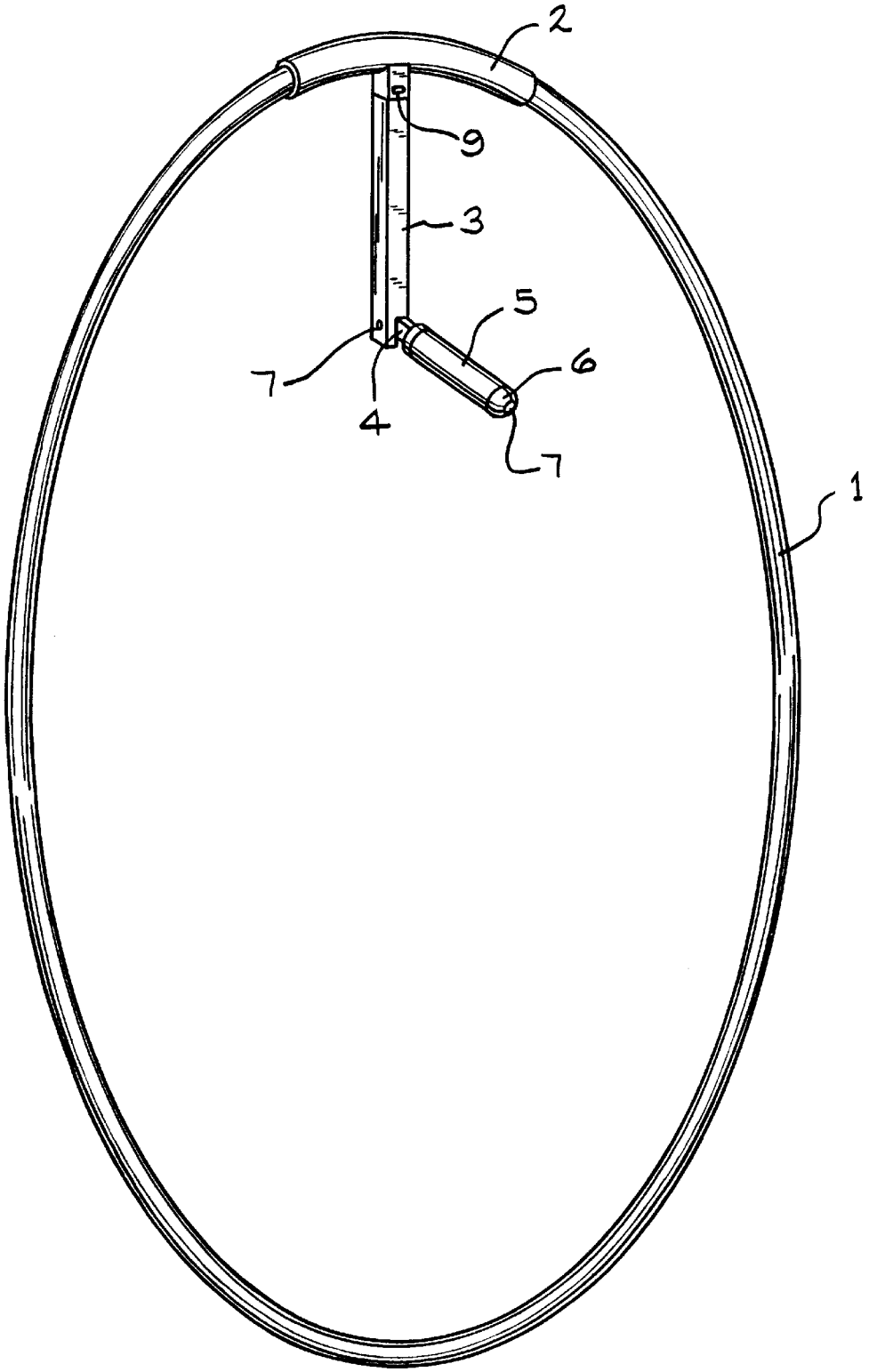
FIG. 1 is a perspective view of the article forming the subject matter of the invention.
Figure 2:
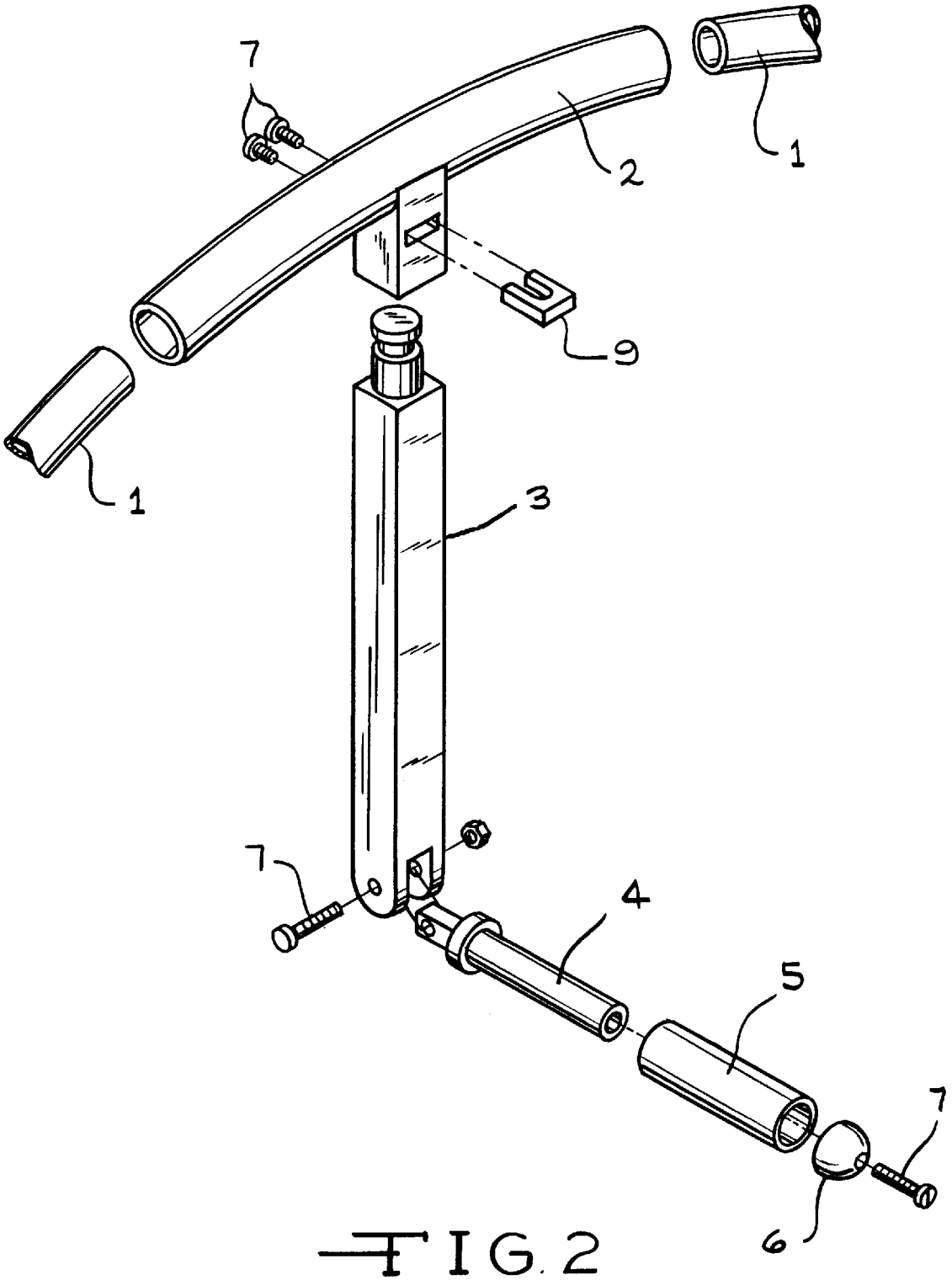
FIG. 2 is an exploded, top perspective view of the article forming the subject matter of the invention.

Referring to the drawings, the present invention includes a hoop 1. The hoop 1 is formed of a rigid lightweight tubing material. The preferred materials are carbon fiber, and fiberglass. The butt ends of the hoop 1 are coupled by being snugly fitted into opposing bores of a tee member 2. The butt ends of the hoop 1 are held in place, inside the tee member 2 by cement or screws.

The tee member 2 is formed of a high impact, strong molded plastic material. The portion of the tee member containing the opposing bores is arcuate. The arcuate portion, of the tee member 2 is formed corresponds to an arc section of the hoop 1 and aids the hoop 1 to maintain a round shape at the weakest portion of the hoop 1, namely, the butt ends. Also, because the tee member 2 is arcuate, between the opposing bores, the hoop 1 and the tee member 2, are able to be connected without stressing the hoop 1 or the tee member 2. The opposing bores of the tee member 2 are the same diameter as the outside diameter of the hoop 1. The adjacent bore of the tee member 2 is the same diameter as the diameter of the cylindrical upper portion of the crank arm 3. The tee member 2 carries a slot, placed to accommodate a retainer 9 that prevents the tee member 2 from withdrawing from the crank arm 3. The retainer 9 engages a groove, placed circumferentially on the cylindrical upper portion of the crank arm 3.

Figure 3:
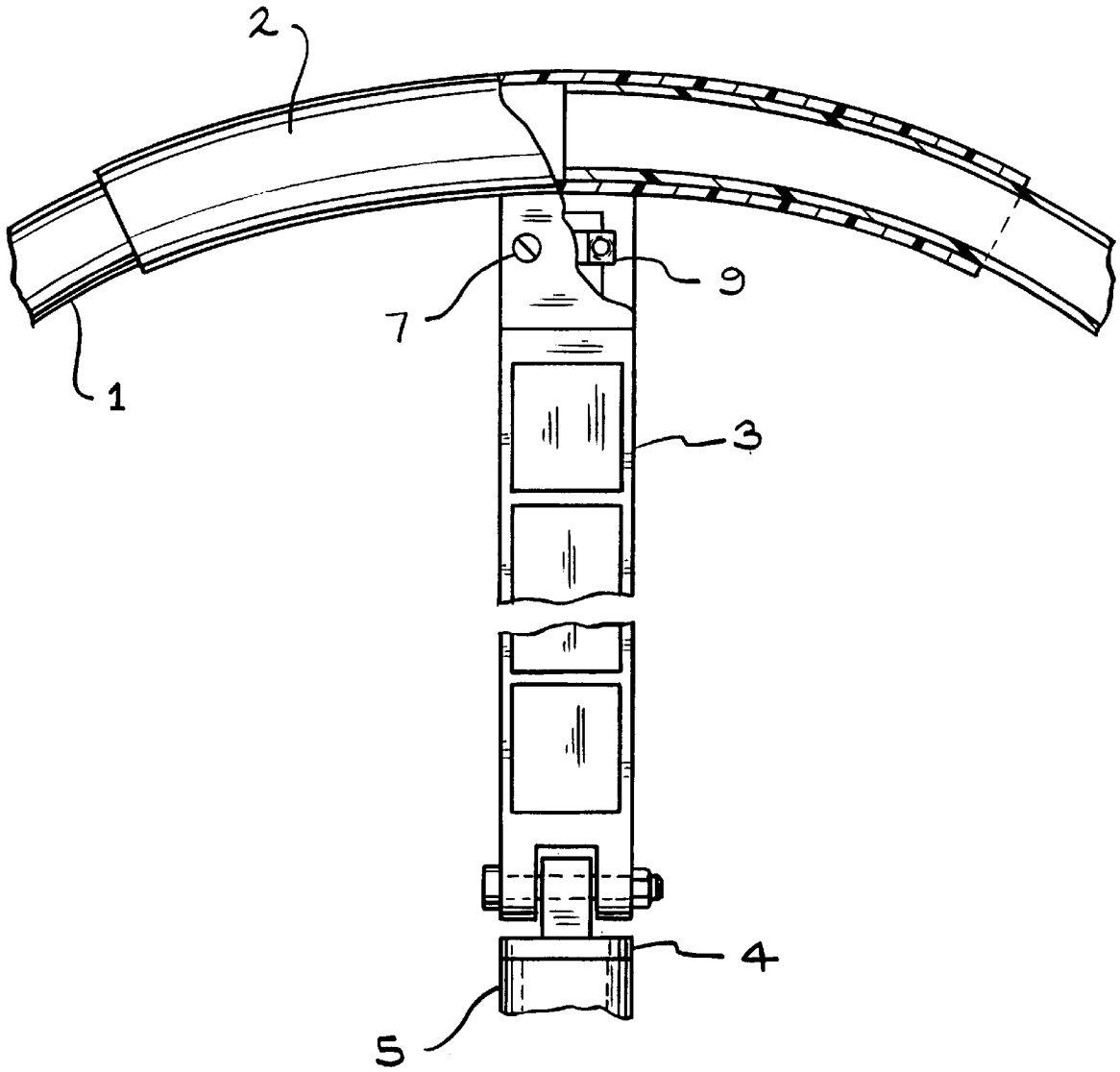
FIG. 3 is a side elevation, fragmentary of the tee member with parts broken away.
Figure 4:
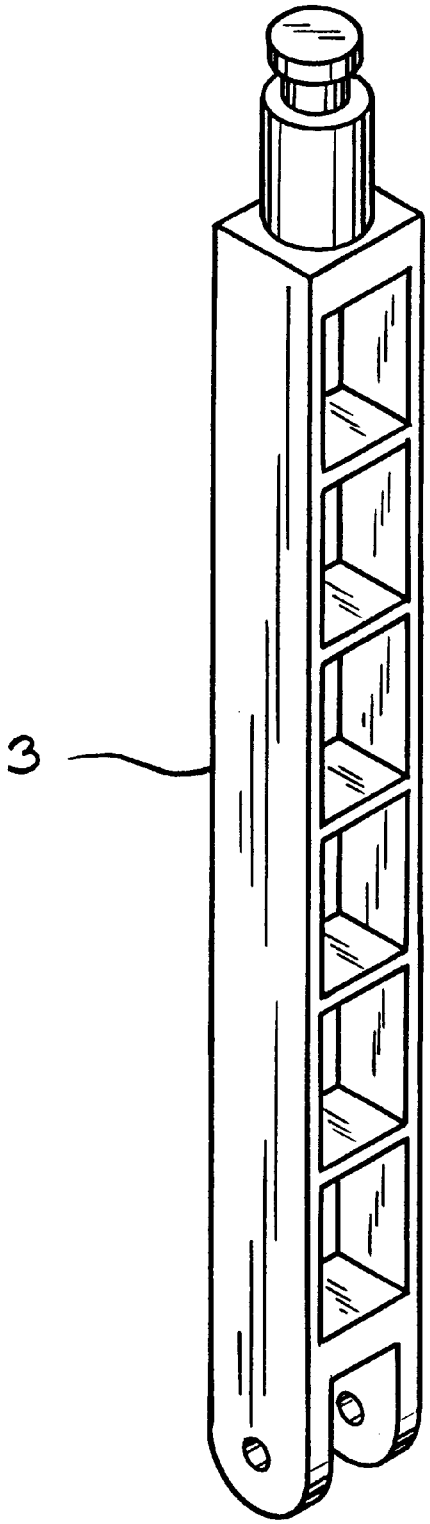
FIG. 4 is a top perspective, rear elevation of the crank arm.

The crank arm 3 is formed, of high impact, strong molded plastic material. The upper portion is cylindrical and has a groove circumferentially placed thereon toward the top of the cylindrical upper portion. The groove accommodates a retainer 9 that prevents disengagement of the crank arm 3 and the tee member 2. The tee member 2 snugly receives the upper cylindrical portion of the crank arm 3 and the retainer 9 is received into the slot on the tee member 2 engaging the groove on the cylindrical upper portion of the crank arm 3. The cylindrical upper portion of the crank arm 3 enables the crank arm 3 to rotate 360° degrees within the tee member 2. The middle portion of the crank arm 3 is voided to save weight but has horizontally placed ribs therein for strength and to prevent the walls of the crank arm 3 from collapsing as the molds are pulled apart during the molding process. The lower portion of the crank arm 3 is channeled to snugly receive the keyed portion of the crank handle 4. The crank handle 4 is able to pivot 180° within the channel on the crank arm 3 and is held in place by a screw 7 that extends through registered holes in the channeled lower portion of the crank arm 3 and the keyed portion of the crank handle 4. The crank handle similarly, is formed of high impact, strong molded plastic material. It is formed into an elongated round rod. One end of the crank handle 4 is keyed, with a flange generally at the keyed end, as best seen in FIG. 3. The keyed end of the crank handle 4 fits snugly into the channeled lower portion of the crank arm 3. A screw 7 extends through registered holes in the keyed end of the crank handle 4 and the channeled lower portion of the crank arm 3 enabling the crank handle to pivot 180° within the axis of the screw 7. The flange on the crank handle 4 prevents the hand grip from sliding over the keyed portion of the crank handle 4.

The hand 5 grip is of a standard sized inexpensive plastic tubing. It is cut to size and placed over the cylindrical end of the crank handle 4. It is held in position by the flange at the keyed end and by an end cap 6 positioned at the cylindrical end of the crank handle 4, through registered holes in the end cap 6 and the crank handle 4.

In use, the present invention is useful as an amusement device or an exercise device. It is used in much the same way as a lariat or a trick rope. The hoop 1 is placed on a vertical plane, and the crank handle 4 and hand grip 5 are pivoted to a position 90° degrees of the hoop 1 and crank arm 3. The user then firmly grasps the hand grip 5 and rotates it in elliptical pattern. The crank handle 4 will begin to rotate within the hand grip 5, causing the crank arm 3 to rotate, thereby imparting revolutions to the hoop 1. The user can now rotate the hoop 1 in a plurality of planes to ones amusement. To duplicate the lariat maneuver of jumping from side to side through a large spinning loop, the user only needs to time the crank arm 3 as it rotates with the hoop 1. Once the user learns to time the crank arm 3 as it rotates with the hoop 1, one can jump through the spinning hoop 1 from one side and back to the other. The trick rope maneuver of lowering a spinning loop down over the user's torso as the loop spins on a horizontal plane, can also be duplicated with the present invention. The user starts the device spinning on a horizontal plane above the head. As the device is spinning, the user gradually lowers it and keeps it spinning by passing the hand grip 5 from one hand to the other in the direction the hoop 1 is spinning. The user can perform another maneuver performed by trick rope users by rotating the present invention on a horizontal plane close to the ground. The user can now hop in and out of the rotating hoop 1. The user will find, that with little skill the present invention will enable a person to duplicate these and many other maneuvers performed by skilled lariat and trick rope users.

It is intended that the hoop 1 be formed in several sizes to accommodate children and adults. For adults and larger children, a suitable hoop 1 would be 5 feet or larger in diameter. For smaller children, a suitable sized hoop 1 would be 3 to 4 feet in diameter. The crank arm 3 would be approximately 1 foot, for the larger hoop 1 and 9 inches for smaller hoop 1. The curvature of the arcuate portion of the tee member 2 would corresponds to an arc section of the size hoop 1 being used.

From the foregoing, it is hoped that the disclosure of the present invention, has made it clear that the stated objectives can be accomplished with this device.

I claim:

1. A crank spinning hoop, comprising:

a substantially rigid hoop, formed of a length of rigid light weight material, a cranking means for imparting revolutions to said hoop, comprising a crank arm, a crank handle, a hand grip, and a retaining means for preventing disengagement of said hand grip from said crank handle and, a tee member containing opposing bores and an adjacent bore that enable said hoop and said cranking means to be joined, said tee member contains retaining means to prevent withdrawal of said crank arm from said tee member.

2. A crank spinning hoop, comprising:

a substantially rigid hoop, formed of a length of light-weight rod material a cranking element, comprising an elongated crank arm, said crank arm having a cylindrical upper portion and a channeled lower portion, an elongated crank handle, said crank handle being a round rod with one end being keyed and having a flange generally at said keyed end of said crank handle, a hand grip, a retaining means to prevent disengagement of said hand grip from said crank handle, and a tee member containing opposing bores and an adjacent bore that enables said hoop and said cranking element to be connected, said tee member is arcuate between said opposing bores, said arcuate portion corresponds to an arc section of said hoop and enables said hoop and said tee member to be connected with very little stress or distortion of said hoop or said tee member, said tee member contains retaining means to prevent disengagement of said crank arm from said tee member.

3. A crank spinning hoop, comprising:

a substantially rigid hoop, formed of a length of rigid lightweight tubing material, a rotatable crank, comprising an elongated crank arm, said crank arm having a cylindrical neck and a channeled lower portion, an elongated crank handle, said crank handle being cylindrical and keyed at one end, said crank handle having a flange generally at said keyed end of said crank handle, a hand grip, and an end cap to prevent withdrawal of said hand grip from said crank handle and, a tee member containing opposing bores and an adjacent bore that enables said hoop and said rotatable crank to be connected, said tee member is arcuate between said opposing bores, said arcuate section corresponds to an arc section of said hoop, said tee member includes a retainer to prevent withdrawal of said rotatable crank from said tee member.

* * * * *